US005255512A

United States Patent [19]

Hamburg et al.

[11] Patent Number: 5,255,512

[45] Date of Patent: Oct. 26, 1993

[54] AIR FUEL RATIO FEEDBACK CONTROL

[75] Inventors: Douglas R. Hamburg, Bloomfield; Thomas R. Culbertson, Redford; Judith M. Curran, Northville, all of Mich.

[73] Assignee: Ford Motor Company, Dearborn, Mich.

[21] Appl. No.: 970,910

[22] Filed: Nov. 3, 1992

[51] Int. Cl.[5] ..... F01N 3/20

[52] U.S. Cl. ..... 60/274; 60/276; 123/674; 123/688; 123/691

[58] Field of Search ..... 123/674, 691, 688; 60/274, 276, 285, 277

[56] References Cited

U.S. PATENT DOCUMENTS

| | | | |
|---|---|---|---|
| 3,939,654 | 2/1976 | Creps | 60/276 |
| 4,364,356 | 12/1982 | Gerhold | 123/691 |
| 4,733,358 | 3/1988 | Abthoff et al. | 123/691 |
| 4,901,240 | 2/1990 | Schmidt et al. | 123/674 |
| 4,912,926 | 4/1990 | Kumagai et al. | 123/691 |
| 5,077,971 | 1/1992 | Kumagai et al. | 123/691 |
| 5,099,647 | 3/1992 | Hamburg | 60/274 |
| 5,115,639 | 5/1992 | Gopp | 60/274 |
| 5,117,631 | 6/1992 | Moser | 60/274 |
| 5,119,628 | 6/1992 | Uema et al. | 60/274 |
| 5,154,054 | 10/1992 | Nakane et al. | 60/277 |
| 5,154,055 | 10/1992 | Nakane et al. | 60/277 |
| 5,157,920 | 10/1992 | Nakaniwa | 123/691 |
| 5,157,921 | 10/1992 | Ito et al. | 60/277 |
| 5,159,810 | 11/1992 | Grutter et al. | 123/691 |
| 5,167,120 | 12/1992 | Junginger et al. | 60/274 |
| 5,168,700 | 12/1992 | Furuya | 60/274 |
| 5,170,769 | 12/1992 | Berger et al. | 123/691 |
| 5,172,549 | 12/1992 | Kako | 60/285 |
| 5,224,345 | 7/1993 | Schnaibel et al. | 123/674 |

FOREIGN PATENT DOCUMENTS

| | | | |
|---|---|---|---|
| 0232106 | 9/1989 | Japan | 60/277 |
| 0136538 | 5/1990 | Japan | 60/277 |
| 0283834 | 11/1990 | Japan | 60/277 |

*Primary Examiner*—E. Rollins Cross
*Assistant Examiner*—Thomas Moulis
*Attorney, Agent, or Firm*—Peter Abolins; Roger L. May

[57] ABSTRACT

An air fuel ratio control system for an internal combustion engine having an electronic engine control module and an upstream and a downstream exhaust gas oxygen sensor positioned in the engine exhaust gas stream. A first feedback loop includes the upstream EGO sensor and an air fuel bias table. A second feedback loop includes a downstream EGO sensor and a trim signal to change the stored values in the air fuel bias table.

6 Claims, 4 Drawing Sheets

AIR FUEL RATIO FEEDBACK CONTROL

BACKGROUND OF THE INVENTION

1. Field of the Invention

This invention relates to electronic engine controls.

2. Prior Art

It is known to use an electronic engine control module to control the amount of fuel being injected into an engine. In particular, it is known to use the output of an exhaust gas oxygen sensor as part of a feedback control loop to control air/fuel ratio. Typically, such an exhaust gas oxygen sensor is placed upstream of the catalyst which processes the exhaust gases. In some applications it is known to use a second exhaust gas oxygen sensor downstream of the catalyst, partly to serve as a diagnostic measurement of catalyst performance. With the presence of exhaust gas oxygen sensors both upstream of the catalyst and downstream of the catalyst, it would be desirable to develop an improved feedback air/fuel ratio control system using signals from both of these sensors.

Referring to FIG. 1, a prior art A/F control system 10 for an engine 11 uses feedback from an exhaust gas oxygen (EGO) sensor 12 installed after a catalyst 13 to trim the control point of a pre-catalyst A/F feedback loop including a pre-catalyst EGO sensor 14, a pre-catalyst feedback controller 15 and a base fuel controller 16. This post-catalyst feedback aids in (1) compensating for aging of pre-catalyst EGO sensor 14, and (2) maintaining the engine A/F in the catalyst window. Such performance improvements help reduce vehicle exhaust emissions. In known system designs, feedback from the post-catalyst sensor is used to slowly trim the A/F of the pre-catalyst loop by either changing the set point of the pre-catalyst EGO sensor or changing the relative values of the up-down integration rates and/or jump back values in the pre-catalyst control loop. A post-catalyst feedback loop includes a post-catalyst feedback controller 17 coupled between post-catalyst EGO sensor 12 and pre-catalyst feedback controller 15.

However, in such post-catalyst/pre-catalyst feedback systems (1) the pre-catalyst EGO sensor exhibits A/F offset errors which vary as a function of engine rpm and torque, and (2) the post-catalyst EGO sensor feedback signal is delayed due to oxygen storage in the catalyst. Since engine rpm and torque change continuously during dynamic operating conditions, the A/F correction applied to the pre-catalyst feedback loop under these conditions may not occur at the same rpm/torque point which generated the feedback signal, and the A/F offset error will consequently be incorrectly trimmed. As a result, such post-catalyst/pre-catalyst feedback systems compensate for aging of the pre-catalyst EGO sensor on the average basis. They do not maintain the engine A/F in the catalyst window at all rpm/torque operating points of the enqine. It would be desirable to have a system to not only compensate for pre-catalyst EGO sensor aging, but to also maintain the engine A/F in the catalyst window for all rpm/torque operating conditions.

SUMMARY OF THE INVENTION

This invention includes the use of a synchronized output of a post-catalyst exhaust gas oxygen (EGO) sensor to trim individual cells of a pre-catalyst air fuel bias table. Such a system provides compensation of the air/fuel ratio feedback system of an engine for pre-catalyst EGO sensor aging and provides the capability to stay in the catalyst window at all rpm/torque operating points.

DETAILED DESCRIPTION OF THE INVENTION

Figure 1:
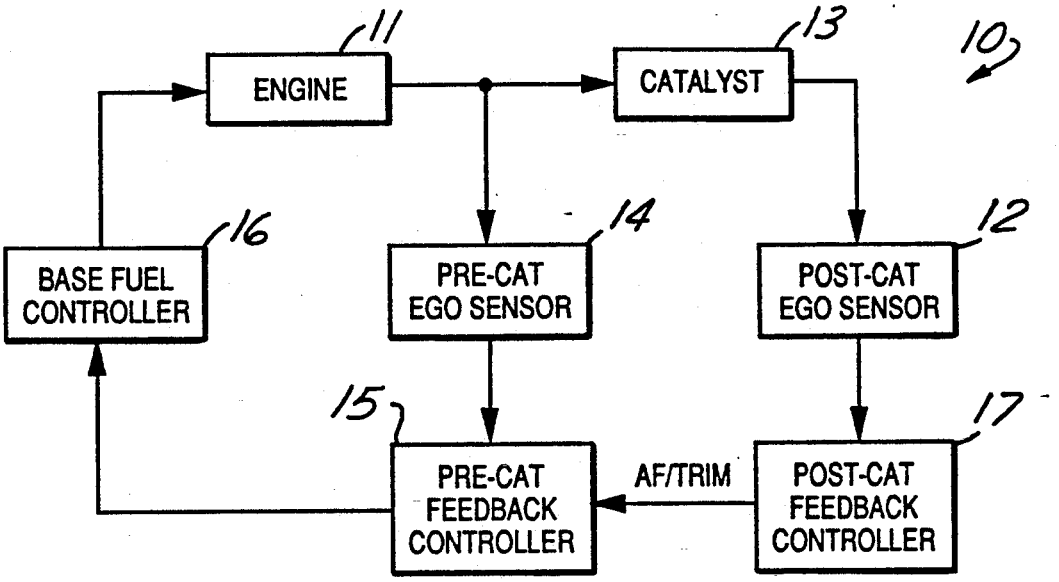
(PRIOR ART) FIG. 1
FIG. 1 is a block diagram of a pre-catalyst/post-catalyst air fuel ratio control feedback system in which post-catalyst feedback provides air fuel ratio trim to a pre-catalyst feedback, in accordance with the prior art.
Figure 2:
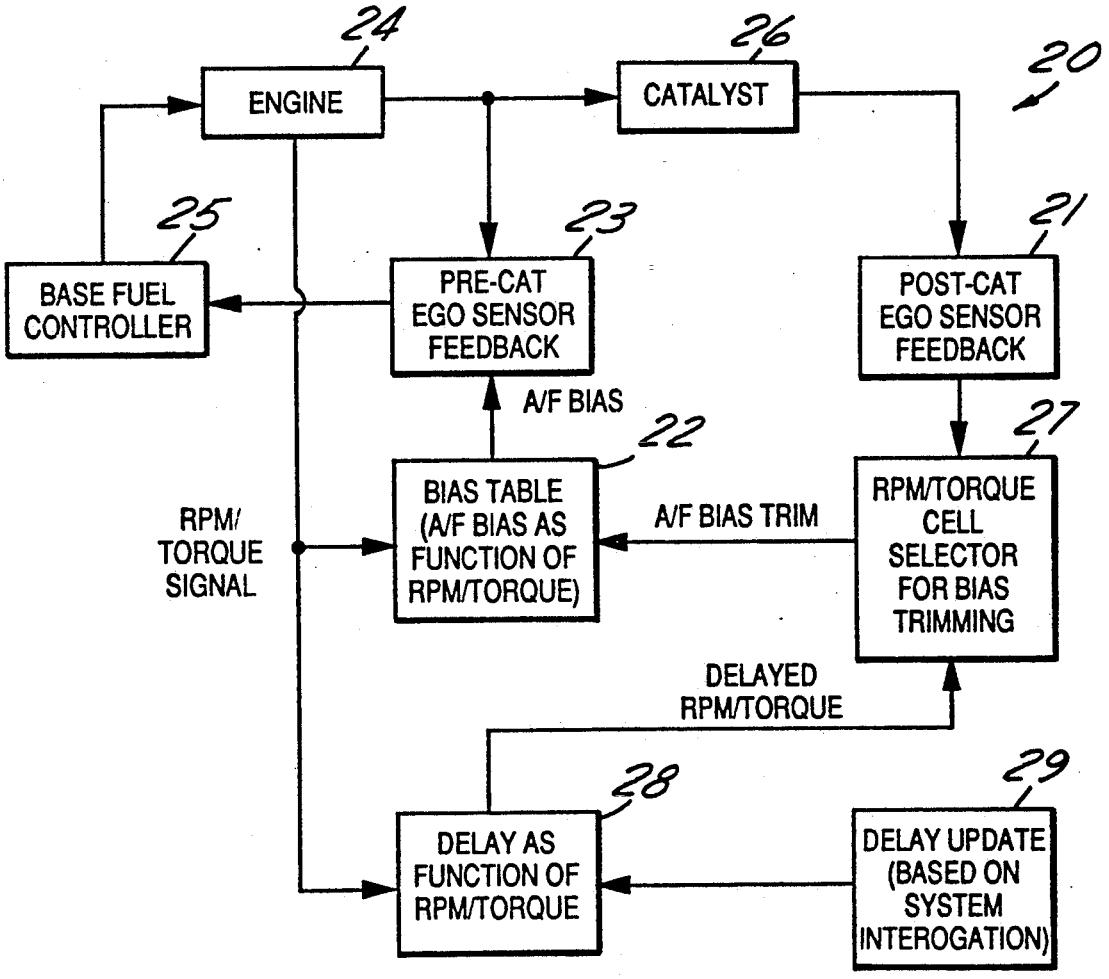
FIG. 2 is a block diagram of a pre-catalyst/post-catalyst air fuel ratio feedback control system in which post-catalyst provides synchronized air fuel trimming to pre-catalyst sensor bias table as a function of engine rpm and torque in accordance with an embodiment of this invention.

Referring to FIG. 2, an air/fuel ratio control system 20 in accordance with an embodiment of this invention uses feedback from a post-catalyst EGO sensor 21 to appropriately trim existing values which are stored in a pre-catalyst closed-loop A/F bias table 22. A base fuel controller 25 is coupled to provide an input to an engine 24. Exhaust from the engine is applied to a catalyst 26. Upstream of catalyst 26, a block 23 generates a pre-catalyst EGO sensor feedback signal. Downstream of catalyst 26, a block 21 generates a post catalyst EGO sensor feedback signal. Block 28 receives rpm/torque inputs from engine 22, and in turn provides delayed rpm and torque signals to rpm/torque cell selector block 27. Block 29 provides updated delay values for block 28 based on interrogation of engine/catalyst system. Block 27 generates an A/F bias trim to update rpm and torque cells of table 22. Table 22 receives rpm and torque signals from engine 24. Table 22 applies an air/fuel bias signal to block 23, which in turn applies an A/F correction signal to controller 25.

Pre-catalyst A/F bias table 22 is a multi-cell table which contains correction values that are used to shift the closed-loop A/F control point of an engine 24 as a function of engine rpm and torque. Various methods can be used to actually shift the engine A/F ratio. These methods include changing the switch point reference of a pre-catalyst EGO sensor 23, changing the up/down integration rates and/or jump back values of the pre-catalyst feedback loop, or changing the relative lean-to-rich and rich-to-lean switching delays associated with pre-catalyst EGO sensor 23. A feature of the invention is the method by which the particular rpm/torque cells of A/F bias table 22 are selected for updating. To be specific, rpm/torque cell selector block 27 selects the proper rpm/torque cell in table 22 to be updated by the feedback signal from post-catalyst EGO sensor 21. Block 27 determines the proper rpm/torque cell based on delayed rpm/torque signals computed in block 28. The delay is necessary to account for the fact that the feedback signal produced by post-catalyst EGO sensor 21 is delayed by the oxygen storage characteristics of catalyst 26.

The operation of air/fuel ratio control system 20 requires that the value of the delay provided by block 28 is known with sufficient accuracy to insure that the post-catalyst feedback signal is applied to the particular rpm/torque cell representing conditions which existed when the feedback signal was actually produced. The delay values can be accessed from either a table containing the values as a function of (for example) rpm and torque, or from a self-contained computer algorithm which computes the delay values based on engine operating conditions. In either case, delay values in the table or calibration constants in the model will be periodically updated to compensate for changes in delay through the catalyst caused by aging. The actual updating process can be accomplished in one of several ways. For example, engine control computer 25 can be programmed to periodically perform closed-loop limit-cycle frequency measurements involving only the post-catalyst feedback loop, and then calculate updated delay values from the measurements. Alternately, control computer 25 can be programmed to periodically inject a known A/F disturbance into engine 24 and then determine the updated delay value by measuring the length of time required for the disturbance to be detected downstream of catalyst 26.

This invention includes a method to update the A/F bias values in the various cells of A/F bias table 22. Specifically, the output of post-catalyst EGO sensor 21 is processed by a voltage comparator circuit which will produce a "rich" signal when the engine A/F is on the rich side of the catalyst window. When a "rich" signal is produced, the post-catalyst feedback controller will slowly ramp a lean correction into the particular cell of the A/F bias table which has been selected by the delayed rpm/torque signal from the control computer. Similarly, when a "lean" signal is produced, the feedback controller will slowly ramp a rich correction into the selected cell of the A/F bias table. Note that applying the feedback correction in this manner is actually just a way to implement low gain integral feedback from post-catalyst EGO sensor 21. Also note that as the engine rpm and load change, the applied correction will automatically be directed to the proper cell of A/F bias table 22. This is because the stored corrections are arranged as a function of engine rpm and load.

Often in engine control systems, the actual signal processing is performed digitally. As such, the post-catalyst feedback could be implemented in several different ways. One example of how the disclosed invention would work and how it could be implemented is now described.

Suppose that engine 24 is operating at a particular rpm and torque point which causes the A/F to be on the rich side of the catalyst window. After sufficient time has passed to account for delay through catalyst 26, the voltage comparator connected to post-catalyst EGO sensor 21 will produce a "rich" signal corresponding to the rpm/torque operating point. As long as the "rich" indication exists, the engine control computer will change the value stored in the addressed cell of the A/F bias table so that the A/F will gradually become leaner. The control computer can accomplish this by continually changing the least significant bit (LSB) of the stored table value at some appropriate rate. The rate at which the LSB is changed would be chosen to provide a sufficiently low feedback gain so that instability (i.e., limit-cycle oscillation) of the post-catalyst feedback loop would never occur. The control computer will continue to make changes in the stored table value until the "rich" signal switches to a "lean" signal. As long as the engine is still operating at the same rpm/torque point, the appropriate corrections (lean or rich) will continue to be applied to the same cell of the A/F bias table.

Suppose now that the engine rpm and torque change so that the addressed cell no longer corresponds to the actual engine operating point. The feedback corrections would nevertheless continue to be applied to the same rpm/torque cell until a time interval corresponding to the delay in the catalyst had passed. The correction would be then switched to the rpm/torque cell corresponding the engine conditions which existed at a time that was earlier by an amount equal to the catalyst storage delay. The process of synchronizing the Post-catalyst correction signal with the proper rpm/torque cell would be performed automatically through the action of the delay block previously mentioned in connection with FIG. 2. If the residence time in any of the rpm/torque cells is very short, no updating of that cell would be performed because (1) uncertainties in the exact time delay could cause cell addressing errors, and (2) short residence times could result in no changes in the rear EGO sensor output because of catalyst oxygen storage.

The type of post-catalyst feedback discussed so far is pure integral control which uses the "rich"/"lean" output signals from a post-catalyst EGO sensor comparator circuit as its input. This is the conventional method of feedback which is employed when switching EGO sensors are used to indicate whether A/F is rich or lean of stoichiometry. It may be advantageous to use a tri-state feedback in order to avoid low-frequency fluctuations in the engine A/F. It should also be noted that it may be advantageous to incorporate correction for EGO sensor temperature effects. Such temperature correction would be used to offset any closed-loop A/F shifts that occur with some EGO sensors when exhaust gas temperature changes.

This invention teaches directing the post-catalyst feedback correction signal to different rpm/torque cells depending on the engine operating conditions. It should be pointed out that the number of cells and the actual rpm and torque ranges of each cell would be chosen to maximize the A/F control accuracy while minimizing system oomplexity. In general, some cells will cover fairly large rpm and torque ranges (such as one cell covering idle, decel, and light load conditions), whereas other cells could cover fairly small ranges. In general, different feedback gain values would be used in each rpm/torque cell. It should be noted that as a limiting case, the number of rpm/torque cells could be reduced to one.

The term EGO sensor refers to exhaust gas oxygen sensors in general. As such, heated exhaust gas oxygen (HEGO) and universal exhaust gas oxygen (UEGO) sensors could be used equally well. Furthermore, the invention could be advantageously applied to feedback systems using post-catalyst emission sensor arrays. Various other exhaust gas emission sensors can be used to detect exhaust gas components such as hydrocarbons or oxides of nitrogen.

Figure 3A:
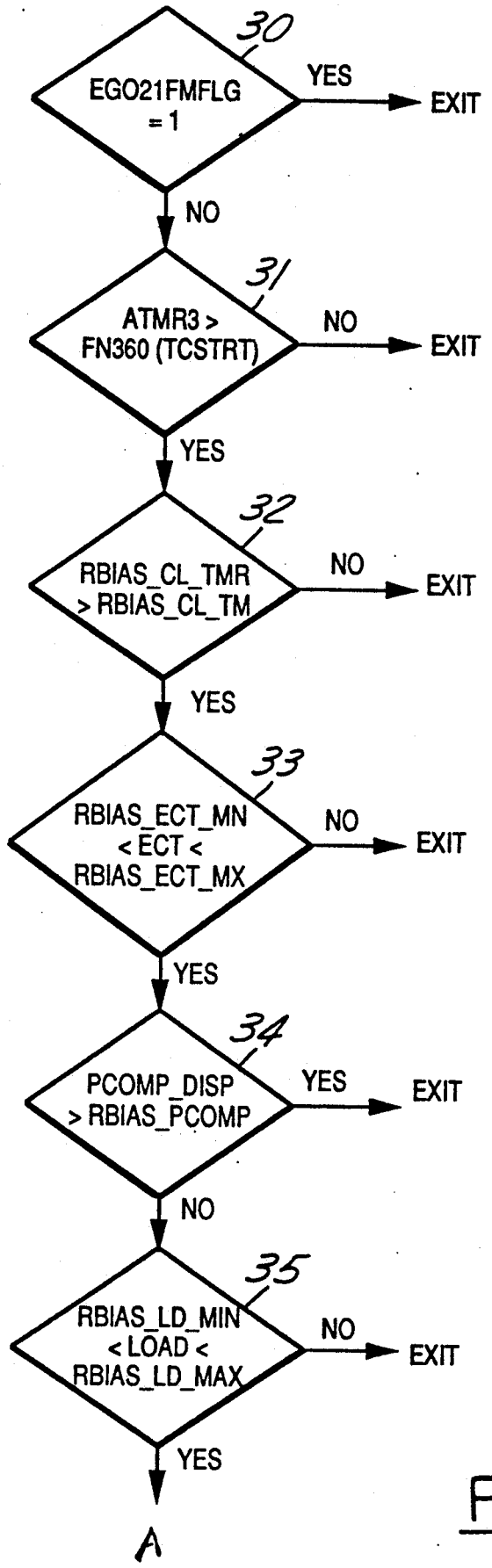
FIG. 3 (including 3A, 3B and 3C) is a software flow chart showing a sequence of logical steps in accordance with an embodiment of this invention wherein feedback from the post-catalyst sensor is used when the engine is operating in a certain rpm/load range.
Figure 3B:
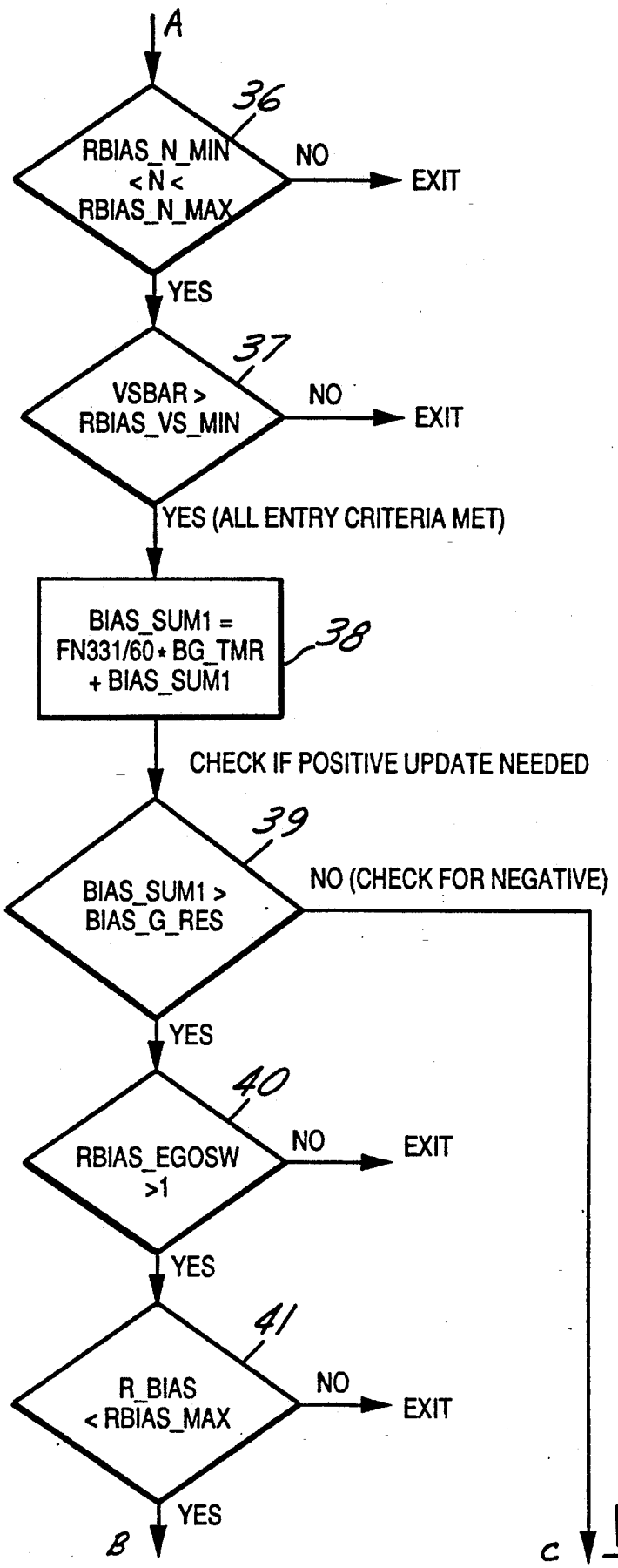
Figure 3C:
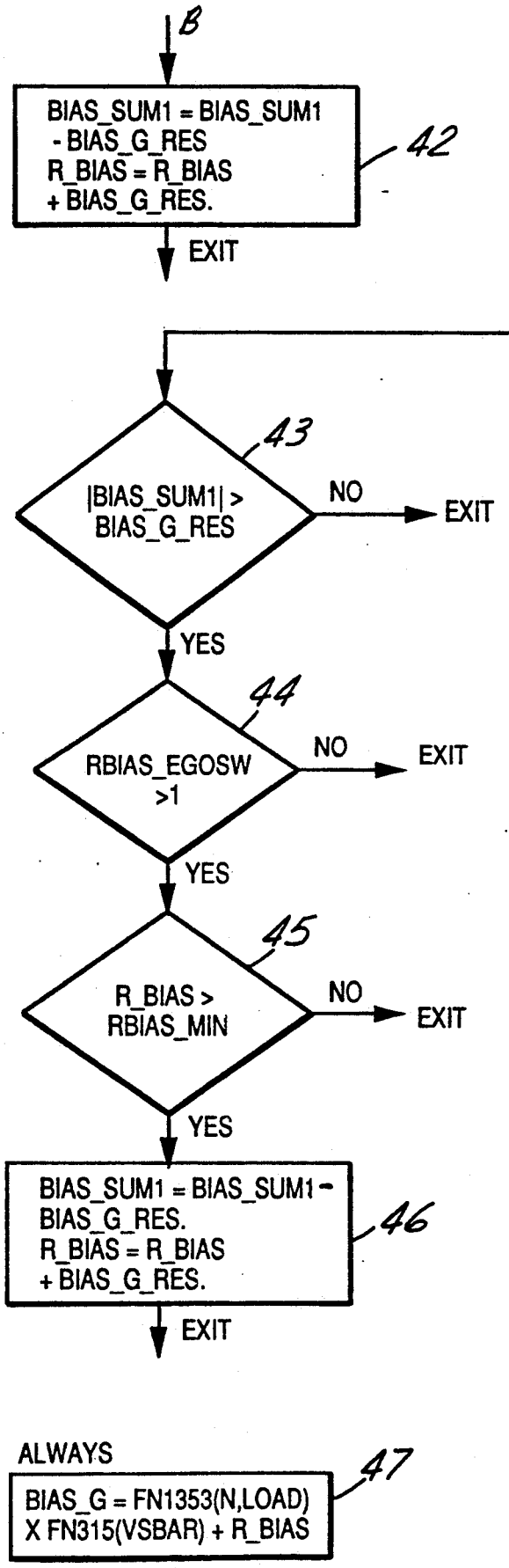

A software flow chart of an embodiment of this invention when operating in one rpm/torque range is shown in FIGS. 3A, 3B and 3C. In this flow chart, blocks 30 through 37 check the entry criteria, while blocks 38 through 47 calculate the rear A/F bias trim value. Throughtout the discussion of this flow chart, bias _G is the normal A/F bias used to adjust engine A/F as a function of rpm and load. R_bias is the A/F bias trim used to modify bias _G based on feedback from the post-catalyst EGO sensor. Bias _suml is an intermediate quantity used to generate R_bias by one bit. Because of this, every time bias_suml increments (or decrements) R_bias by one bit, the bias suml register is decremented (or incremented) by the number of bits corresponding to the one bit R_biasl register. With this introduction, the flow chart embodiment of this invention begins with a block 30 inquiring whether the rear EGO has failed. If yes the logic flow is exited. If no, logic flow goes to a block 31 wherein it is determined if the rear EGO has warmed up. This is done by comparing a ATMR3, times since start, to a function of TCSTRT which is the temperature of the engine coolant at start. If the rear EGO has not warmed up, logic flow is exited, and if it has, logic flow goes to a logic block 32. At block 32 it is determined whether the front control loop has been closed-loop long enough for the catalyst to stabilize. If not, the logic flow is exited. If yes, logic flow goes to a block 33 wherein it is determined if the engine is stabilized and not over heating. If not, logic flow is exited. If Yes, logic flow goes to a block 34.

In block 34 it is determined if the evaporative purge flow is too high. If yes, logic flow is exited. If no, logic flow goes to a block 35. In block 35 it is determined whether the load indicates a cruise condition. If not, logic flow is exited. If yes, logic flow goes to a block 36. At block 36 it is determined if the engine rpm indicates a cruise condition. If no, logic flow is exited. If yes, logic flow goes to a block 37. At block 37 it is asked if the vehicle speed indicates a cruise condition. If not, logic flow is exited. If yes, logic flow goes to a block 38. At block 38 the rear EGO trim is updated depending upon the calibration of a function FN331. Logic flow then goes to a decision block 39 wherein it is determined if the bias suml is greater than one bit resolution of bias G. Bias G is a low resolution, high range register that is used in the fuel algorithm to bias the average air/fuel ratio rich or lean. If no, logic flow goes to a decision block 43 wherein there is a check for a need for a negative update. If yes, logic flow goes to a block 40. At block 40 it is determined whether the front EGO switched since the last R_bias update. This verifies the front loop is at stoichiometric operation. If not, the logic flow is exited. If yes, logic flow goes to a block 41. At block 41 it is determined if the R_bias is less than the maximum (lean) clip. If no, logic flow is exited. If yes, logic flow goes to a block 42. At block 42 there is an increment of R_bias one bit (leaner) and for the reason given earlier, a decrement of the bias_suml by the one bit resolution of bias_G.

When logic flow goes from block 39 to block 43, it is to a decision block where it is checked to see if a negative (richer) update is needed. There is a determination if the absolute value of the bias_suml is greater than one bit resolution of bias_G. If not, the logic flow is exited. If yes, logic flow goes to a decision block 44. At decision block 44 it is checked if the front EGO has been switched since the last R_bias update. If not, logic flow is exited. If yes, logic flow goes to a block 45. At block 45 it is determined whether the R_bias is greater than the minimum clip. If no, logic flow is exited. If yes, logic flow goes to a block 46. At block 46 there is a decrement of R_bias one bit (richer) and increment bias_suml by the one bit resolution of bias_G. Logic flow is exited from block 46. Throughout the routine there is always a block 47 action wherein there is an updating of bias_G and a determination of the base bias and R_bias as a result of the pre-catalyst/post-catalyst control.

What is claimed:

1. A method of oontrollinq air/fuel ratio using electronic engine controls for an internal combustipn engine including the steps of:

providing a pair of sensor means for characterizing at least one constituent of an exhaust gas in an exhaust stream from the internal combustion engine, a first sensor means being positioned upstream of a catalyst and a second sensor means being positioned downstream of the catalyst;

providing a control module having an input connected to the upstream and downstream sensors means and an output connected to the actuators controlling the engine, as to establish a first feedback loop including loop including the second downstream sensor means;

providing an air/fuel ratio bias table with individual cells in said first feedback loop to alter the transfer function of said first feedback loop; and using a synchronized output of said second downstream sensor means to trim individual cells in the air/fuel bias table thereby compensating the first and second air/fuel ratio feedback loops for aging of said first upstream sensor means and providing the capability to stay within a catalyst window of operation as a function of engine speed and torque operating points.

2. A method as recited in claim 1 which said sensor means is an exhaust gas oxygen (EGO) sensor and further comprising using a tri-state feedback in at least one of said first and second feedback loops in order to avoid low frequency fluctuations in the air/fuel ratio control system.

3. A method as recited in claim 2 further comprising the step correcting for EGO sensor temperature effects.

4. A method as recited in claim 2 wherein said second sensor means is an exhaust gas emission sensor.

5. A structure for controlling air/fuel ratio of an electronic engine control system including:

a first upstream exhaust gas oxygen sensor positioned in front of a catalyst in the exhaust gas of the engine;

a second exhaust gas oxygen sensor, downstream from said first exhaust gas oxygen sensor and catalyst, coupled to the exhaust gas stream of the engine;

a trim table update means coupled to the said second EGO sensor for providing synchronized A/F trim values;

a trim table having memory cells storing an air/fuel trim amount as a function of rpm and torque and coupled to said trim table update means for receiving said trim update, and said first EGO sensor with its associated controller being coupled to said trim table for processing output of said trim table, an air/fuel ratio bias trim, and providing an output to an engine control module.

6. A structure as recited in claim 5 further comprising:

a delay means as a function of rpm and torque block coupled to receive an input from the engine and to provide an output of delayed rpm and torque to said trim table update; and a delay update means based on system interrogation providing an input to said delay as a function of rpm/torque.

* * * * *